United States Patent [19]

Benjamin

[11] 3,952,348

[45] Apr. 27, 1976

[54] WATER MATTRESS CONSTRUCTION

[75] Inventor: Gary L. Benjamin, Mount Blanchard, Ohio

[73] Assignee: R. L. Kuss & Co., Inc., Findlay, Ohio

[22] Filed: Sept. 2, 1975

[21] Appl. No.: 609,437

[52] U.S. Cl. ..... 5/370 WI; 5/348 R

[51] Int. Cl.[2] ..... A47C 27/08

[58] Field of Search .... 5/348 R, 349, 350, 348 WB; 156/145, 217, 227, 252; 264/321

[56] References Cited

UNITED STATES PATENTS

| | | | |
|---|---|---|---|
| 3,251,075 | 5/1966 | Saltness et al. | 5/348 R |
| 3,753,823 | 8/1973 | Kuss | 156/145 |
| 3,849,814 | 11/1974 | Ross | 5/348 WB |

*Primary Examiner*—Casmir A. Nunberg
*Assistant Examiner*—Andrew M. Calvert
*Attorney, Agent, or Firm*—Vincent L. Barker, Jr.; Thomas M. Freiburger

[57] ABSTRACT

A water mattress construction is disclosed. The construction involves a folded one-piece vinyl sheet wherein the only longitudinal seam is located on the bottom, thereby avoiding side seams on the mattress and wherein the end seams are located below the upper mattress surface. Lap seams are used throughout for additional strength.

2 Claims, 3 Drawing Figures

WATER MATTRESS CONSTRUCTION

BACKGROUND OF THE INVENTION

The invention relates to water beds, and more particularly to an improved water mattress construction wherein longitudinal side seams on the mattress are eliminated.

A water mattress construction is shown in U.S. Pat. No. 3,753,823. In such construction, the mattress is folded from an elongate vinyl sheet which is essentially, double the length of the vinyl mattress, in such a way that there results one end with no seam, and an end and two sides each having a seam throughout their lengths. The four vertical corners also define seams, since the mattress is of a box-like three-dimensional shape rather than a flat shape prior to filling.

Most water mattresses heretofore produced are either folded and seamed in a manner similar to that shown in the above patent, or are of two-piece construction, with a single seam extending throughout the perimeter, being located about halfway up the sides and the ends of the mattress when it is filled. Most mattresses of the latter type construction are produced in a flat two-dimensional configuration so that only when filled with water do they assume a third dimension. The ends and sides tend to assume a tapered cigar shape, so that when such a mattress is filled in a rectangular frame, it only roughly conforms to the frame and wrinkles at its corners.

The types of water mattress construction discussed above, particularly that of the above cited patent employing lapped seams throughout, have resulted in a relatively high resistance to wear and seam leakage problems. However it has been found that the side seams of a water mattress can cause problems after a prolonged period of usage. When a water mattress fails and leakage occurs, the failure point is nearly always located on one of the side seams somewhere in the vicinity of one of the corners, e.g., between the corner itself and a distance of about 18 inches from the corner. It is believed that the reason for such failures is related to a repeated pattern of wrinkle formation in the vinyl material, wherein the wrinkles extend down from the upper surface of the mattress to the seam and often tend to remain in the material. The wrinkles are usually caused by persons sitting on the side of the mattress when the mattress is in its frame. Since the corners of the water mattress in its frame have less support than the sides, due to the fact that they are always drawn inwardly when weight is placed upon the mattress, the wrinkles generally tend to run from the position where the person sits outwardly toward the vicinity of the corner. If the sitting is repeated over a period of time, the wrinkling tends to follow a certain pattern. The repeated wrinkling pattern, taken together with the aging of the vinyl material and the gradual loss by evaporation of plasticizers therefrom, results in a fatiguing of the vinyl material and either separation or rupture of the material at the seam.

SUMMARY OF THE INVENTION

The present invention is a water mattress construction which eliminates side seams on the mattress but does not compromise the integrity of the mattress by locating seams in other vulnerable positions. The water mattress is folded from a single sheet which is initially essentially double the width of the mattress, rather than double the length. Accordingly, the mattress is folded into a three-dimensional rectangular solid configuration by folding along length which are parallel to the lengt of the finished water mattress. The mattress is sealed along a single longitudinal seam which is approximately centrally located in the bottom of the mattress, preferably in a lap seam. The end flaps are then brought together and lap seamed to form the finished rectangular box configuration. The final seams are formed by using access openings according to the teachings of U.S. Pat. No. 3,753,823. The access openings, including that which is eventually covered with a water filling fitting, may each be located in one of several locations, depending upon the position of the longitudinal mattress seam.

By the water mattress construction according to the invention, a stronger, more durable and failure-resistant mattress results with less total length of seaming than that occuring in prior types of construction.

DESCRIPTION OF THE PREFERRED EMBODIMENTS

Figure 1:
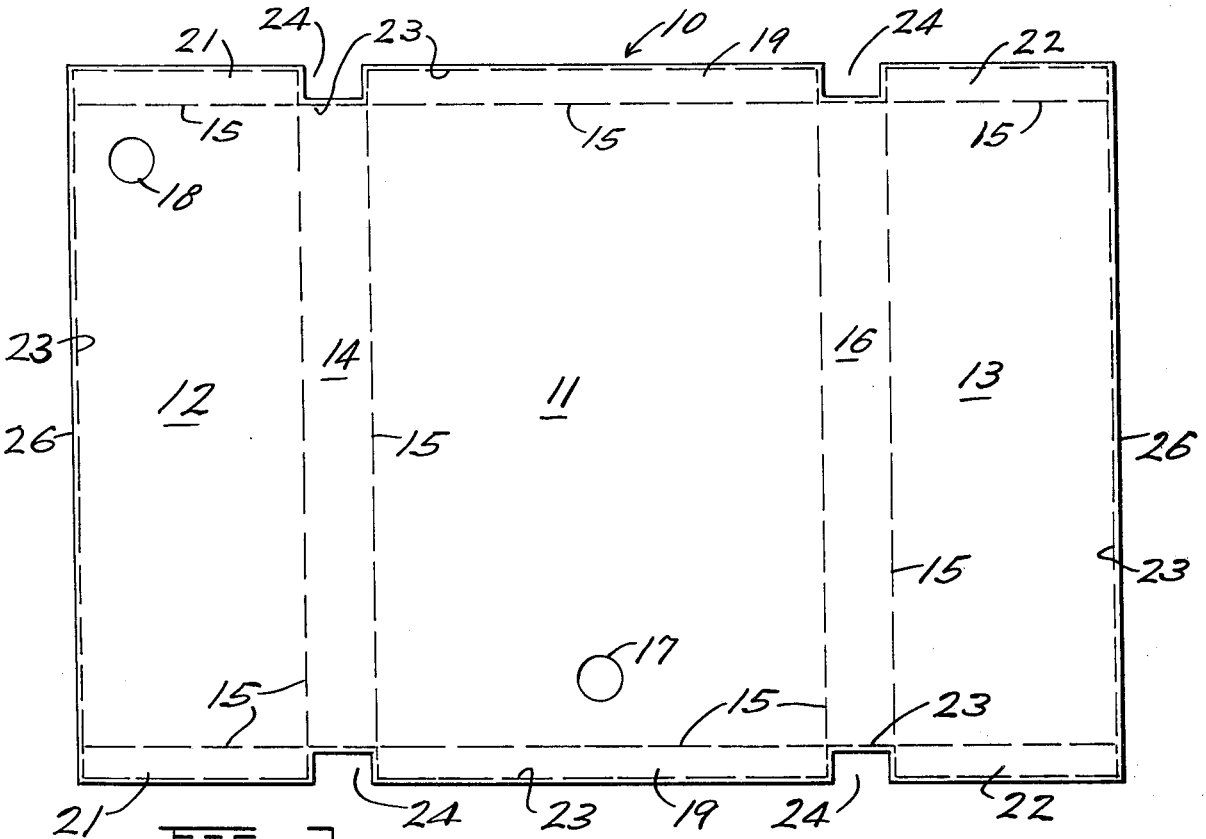
FIG. 1 is a plan view showing a developed sheet of material to be used in producing a water mattress according to the invention.

In the drawings, FIG. 1 shows a sheet of water mattress material 10, preferably vinyl chloride, in a flat, developed layout as it appears when it is initially cut. As seen in the drawing, the sheet 10 is somewhat more than double the width of the finished mattress, with areas 11, 12 and 13 indicated as designated for the top surface and left and right portions of the bottom surface, respectively. Intermediate areas 14 and 16 are to form the sides of the assembled water mattress. Neither of the sides will contain a longitudinal seam. Dashed lines 15 indicate where the sheet of material 10 is to be folded.

Access openings 17 and 18 are included in the sheet 10 for performing the final sealing of the seams. The opening 17 in the top surface 11 of the sheet will ultimately receive a valved water filling and air outlet fitting, while the opening 18 in a portion of the bottom surface of the mattress will receive a patch following the final sealing operations. The matter of use of the access openings 17 and 18, and the manner in which they are ultimately closed, are discussed in the above cited U.S. Pat. No. 3,753,823.

Still referring to FIG. 1, the sheet of water mattress material 10 includes end flaps 19 at the ends of the top surface 11 and end flaps 21 and 22 at the ends of the left and right portions 12 and 13, respectively, of the bottom surface. Dashed lines 23 indicate the areas of overlap of the end flaps and of other edges which are to be assembled together into lap seams in the finished water mattress. Lap seams have much greater resistance to stress than do fin type seams. In notched areas 24 at the ends of the side panels 14 and 16, the areas of overlap are ultimately brought together, with the sheet 10 folded along the fold lines 15, to form the four corners of the water mattress. Outer edges 26 of the cut mattress sheet 10 also include overlap areas which will ultimately be brought together and sealed.

Figure 2:
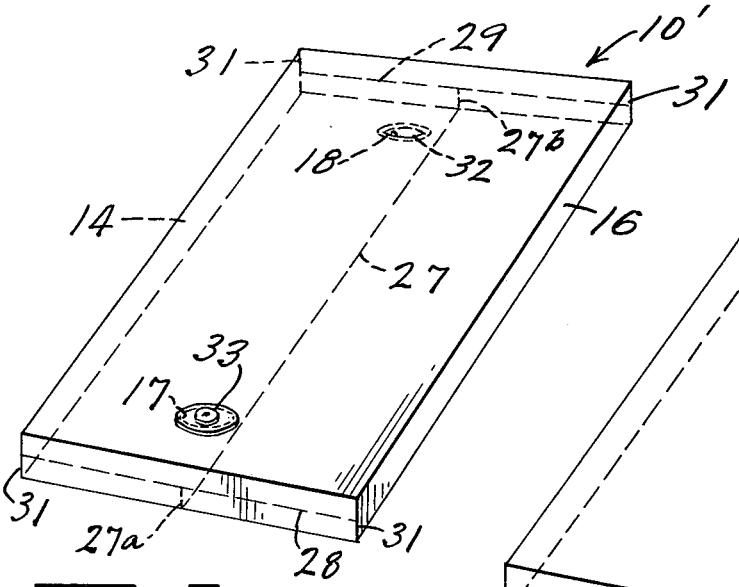
FIG. 2 is a perspective view showing the water mattress as folded and sealed together, with the location of the seams indicated.

FIG. 2 shows the water mattress 10' in its assembled configuration. The mattress 10' includes no longitudinal seams in the panels 14 and 16, but rather a central longitudinal seam 27 in the bottom of the mattress. End seams 28 and 29, preferably lap seams as discussed above, tie in with short vertical seams 27*a* and 27*b* running upwardly from the seam 27 to form a completed mattress enclosure. Of course, vertical seams also occur at corners 51 of the completed mattress 10'. These seams, as well as the remaining lap seams discussed above, are preferably formed according to the teachings of U.S. Pat. No. 3,753,823.

Following the completion of the final seam sealing operations, the access openings 17 and 18 are closed. The opening 18 is preferably closed by a patch 32 sealed thereto, while a combination fill and vent fitting 33 is preferably sealed to the surface of the mattress at the opening 17. These operations are also discussed in the above cited patent. The combination fill and vent fitting 33, schematically indicated in FIG. 2, usually comprises a single cappable opening which is large enough to receive a garden hose and simultaneously vent air outwardly.

Figure 3:
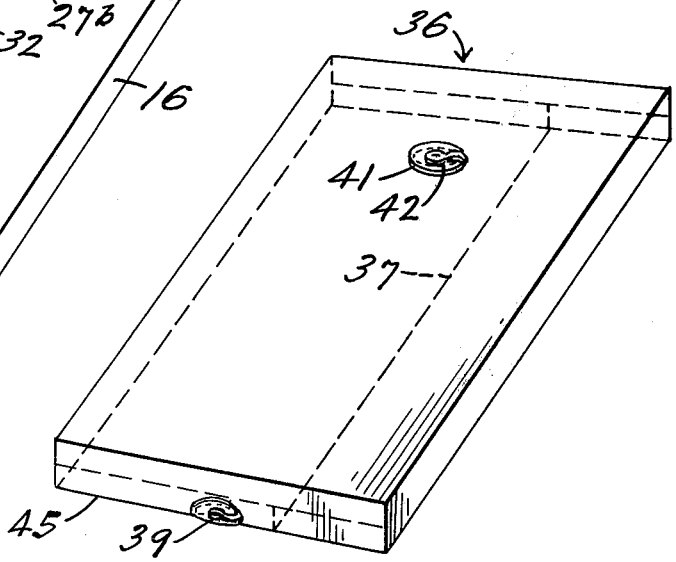
FIG. 3 is a view similar to FIG. 2 but showing an alternative embodiment of the completed water mattress.

FIG. 3. shows an assembled water mattress 36 representing a second embodiment of the invention. The mattress 36 is similar to the mattress 10' of FIG. 2 except that the single longitudinal seam 37 of the mattress 36 is somewhat offset from the center of the mattress bottom. The reason for this location is to accommodate a fill tube fitting 39. An air vent fitting 41 is separate from the fill tube 39 in this embodiment, being located toward the opposite end of the mattress 36 so that the opening for the fitting 41, prior to its assembly, can serve as an access opening. The fill tube fitting 39 is adapted to be sealingly connected to a garden hose during the filling of the water mattress 36, and thereafter sealed closed. The vent opening 41, which must be located in the top surface of the mattress to allow air to escape during filling, is provided with a closure 42.

As indicated in FIG. 3, the fill tube fitting 39 is so located as to straddle a bottom end fold 45 of the mattress 36. This is advantageous in that the fill tube 39 must extend from the end of the mattress rather than the bottom for convenience, and it is best to avoid coincidence of the bottom fold line 45 with a tangential circular seam associated with the end tube fitting 39. Thus, the perimeter of the fitting 39 crosses the fold line 45 approximately perpendicularly.

The water mattresses 10' and 36 of FIGS. 2 and 3 are resistant to fatigue seam failure to an extent not known before in three-dimensional box-shaped water mattresses or mattresses of other constructions. The repeated pattern of wrinkling from the top surface of a framed water mattress outward and downward toward the sides, as discussed above, cannot be concentrated on a side seam area to eventually cause fatigue and failure of water mattresses constructed according to the invention. Also, the total length of seams in the water mattress construction described herein is less than that of any other known water mattress construction, since only a single longitudinal seam occurs and the remaining horizontal seams are located in the ends of the mattress, which are normally shorter than the sides. Moreover, the seams are located in non-critical areas of the water mattress where unusual stresses normally do not occur and where fatigue and failure has never been found to be a problem.

I claim:

1. A water mattress of three-dimensional, rectangular box-like construction fabricated from a unitary sheet of a flexible material, comprising a top panel, a pair of vertical side panels folded downward on either side of the top panel, a pair of upper end panels folded downward at either end of the top panel, a first bottom panel portion folded horizontally inwardly from the lower edge of one of the vertical side panels, a second bottom panel portion folded horizontally inwardly from the lower edge of the other of the vertical side panels and in lap-seamed engagement with the first bottom panel portion, a first pair of lower end panels folded vertically upward at either end of the first bottom panel portion and in lap-seamed engagement with the corresponding edges of the upper end panels above, a second pair of lower end panels folded vertically upward at either end of the second bottom panel porton and in lap-seamed engagement with the corresponding edges of the upper end panels above, a lap seam between the adjacent edges of adjacent lower end panels at each end of the mattress, and lap seams at each corner of the mattress among the side panels, the upper end panels and the lower end panels.

2. A water mattress fabricated from a unitary sheet of flexible material folded and seamed into a hollow rectangular three-dimensional shape comprising a rectangular top panel providing the upper exposed mattress surface, a pair of vertical rectangular side panels on either side of said top panel folded downwardly therefrom, a rectangular half bottom panel extending from the lower edge of each of said side panels and folded inwardly therefrom with the innermost edges thereof in overlapping sealed relationship to form a rectangular bottom panel parallel to and coextensive with said top panel with said overlapped edges forming a lap seam extending the length thereof, a partial end panel extending from the ends of each of said top and bottom panels at right angles thereto toward the opposed end panel and terminating with the innermost edge thereof in overlapping sealed relationship to form, at each end of the mattress, a rectangular end panel parallel to its opposite member with the spaced overlapped edges forming a lap seam extending the length of said end panel, the width of said partial end panels being such that said end panel lap seam is positioned at least half the width of said end panel below said top panel, and with lap seams at each corner of said mattress between adjacent vertical edges of said side and end panels.

* * * * *